United States Patent [19]

Pitts

[11] Patent Number: 4,840,406

[45] Date of Patent: Jun. 20, 1989

[54] METHOD OF MOUNTING INDEX TABS UPON STENOGRAPHIC NOTEBOOKS

[75] Inventor: Warren R. Pitts, Needham, Mass.

[73] Assignee: Dennison Manufacturing Company, Framingham, Mass.

[21] Appl. No.: 55,406

[22] Filed: May 29, 1987

[51] Int. Cl.[4] ..... B42D 13/00; B42D 1/00

[52] U.S. Cl. ..... 281/1; 402/4; 402/500; 402/501

[58] Field of Search ..... 281/1; 402/3, 4, 500, 402/501

[56] References Cited

U.S. PATENT DOCUMENTS

| | | | |
|---|---|---|---|
| 1,687,859 | 10/1928 | Fontaine | 402/500 X |
| 2,718,229 | 9/1955 | Gregory | 402/501 X |
| 3,366,119 | 1/1968 | O'Connor | 402/500 |
| 4,053,057 | 10/1977 | Snowden | 402/4 X |
| 4,479,733 | 10/1984 | Segal | 402/501 X |

FOREIGN PATENT DOCUMENTS

| | | | |
|---|---|---|---|
| 2727500 | 12/1978 | Fed. Rep. of Germany | 402/500 |

*Primary Examiner*—Paul A. Bell

[57] ABSTRACT

Two methods for mounting index tabs to coiled wire bound stenographic notebooks are disclosed. The first method involves providing one or more elongated transparent plastic envelopes having a plurality of aligned apertures adjacent a lower envelope edge, the apertures surrounding turns of the coled wire, the envelopes also having two open side portions and an upper closed envelope edge portion, and inserting index tabs through the open side portions until the tabs are contained within the envelopes. A "snap-on" version, marketed apart from the notebook, is disclosed in addition to tabs which are affixed to the coiled wire during manufacture. A second method involves providing a flat elongated base member having at least one area for recording indicia thereon, and having first and second catch members at opposite terminal portions of the base member, separated from each other by a distance slightly less than the length of the coiled wire, and reducing the length of the coiled wire by asserting pressure thereon while slipping a hook portion of the base member past the coiled wire and about a turn thereof to mount the base member upon the notebook.

20 Claims, 1 Drawing Sheet

METHOD OF MOUNTING INDEX TABS UPON STENOGRAPHIC NOTEBOOKS

BACKGROUND OF THE INVENTION

The present invention relates to the field of stenographic notebooks.

It is deemed desirable to save stenographic notebooks rather than discarding them since they contain information which may be useful at future times. In order to retrieve particular data from stenographic notebooks stored for later use, it is desirable to provide various devices for readily applying and removing index tabs from the stenographic notebooks.

It is thus an object of the present invention to provide simple and inexpensive devices for indexing conventional coiled wire stenographic notebooks.

It is also an object of the invention to provide devices for mounting index tabs which enable rapid application and removal of the tabs to and from the stenographic notebooks.

SUMMARY OF THE INVENTION

A first method of mounting index tabs to coiled wire stenographic notebooks, involves providing one or more elongated transparent plastic envelopes having a plurality of aligned apertures adjacent a lower envelope edge, the apertures surrounding turns of the coiled wire, the envelopes also having two open side portions and an upper closed envelope edge portions, and inserting index tabs through the open side portions until the tabs are contained within the envelopes. A "snap-on" version, marketed apart from the notebook, is disclosed in addition to tabs which are affixed to the coiled wire during manufacture.

A second method involves providing a flat elongated base member having at least one area for recording indicia thereon, and having first and second catch members at opposite terminal portions of the base member, the catch members having facing terminal hook portions separated from each other by a distance slightly less than the length of the coiled wire, and reducing the length of the coiled wire by asserting pressure thereon while slipping a hook portion of the base member past the coiled wire and about a turn thereof to mount the base member upon the notebook.

Other objects, features and advantages of the invention will become apparent upon study of the following detailed description taken in conjunction with the drawings in which:

FIGS. 1 through 3 disclose a first embodiment of the invention;

FIG. 4 discloses a second embodiment of the invention; and

FIG. 5 discloses a third embodiment of the invention.

DETAILED DESCRIPTION

Figure 2:
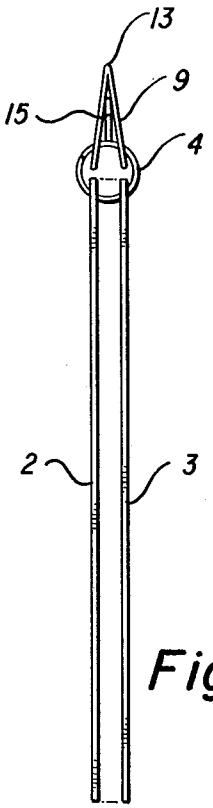
Figure 1:
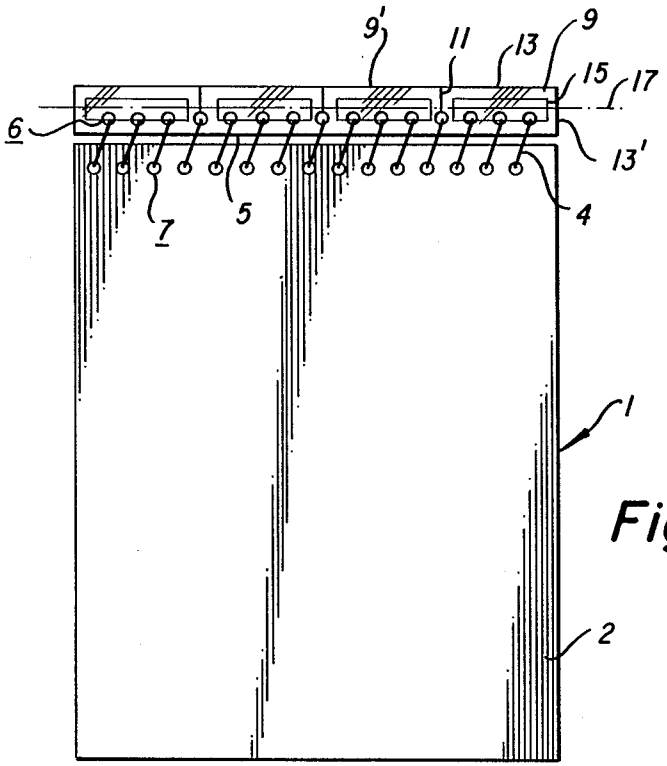

In FIGS. 1 and 2, a conventional stenographic notebook 1 is disclosed having a front stiff cover 2 and a back cover 3 surrounding the notation sheets (not shown). A series of circular apertures 7 are formed adjacent upper edges of cover sheets 2 and 3 and coil spring 4 passes through apertures 7 in the front and back covers and in the notation sheets in the conventional manner.

A plurality of transparent plastic envelopes 9 are provided, have a series of apertures therein formed adjacent the lower edges 6 of the envelopes as shown in FIG. 1. The envelopes may be affixed to the notebook 1 upon manufacture by having each turn of coil spring 4 pass through each of the series of aperture 6. A plurality of slits 11 are cut perpendicular to the longitudinal envelope axis 17 and preferably extend into apertures 6 as illustrated. The envelopes are preferably formed by folding plastic sheets at portion 13 to form a closed upper envelope edge. On the other hand, the opposite lower edges of the envelopes need not be closed since the tabs 15 to be inserted into the envelopes will be prevented from falling out of the lower edges of the envelopes by the presence of the turns of spring coil 4.

Figure 3:
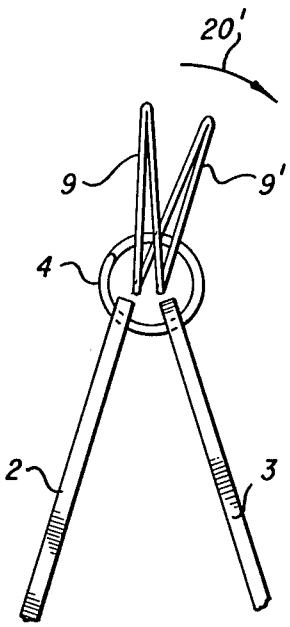

Thus, tab 15 bearing indexing indicia is inserted into the right hand envelope by passing the leading edge of the tab through the open side portion 13'. The second tab to be inserted is inserted into the left hand envelope in the same manner. Now let it be assumed that a third tab is to be inserted into envelope 9' formed by virtue of slits 11. Envelope 9' is manually pushed away from longitudinal axis 17 of the envelope array in the direction indicated by arrow 20 shown in FIG. 3. This enables a third tab to be readily inserted into the side portion of envelope 9' since it is displaced away from the major plane of the envelope array. After this step is completed, envelope 9' will return to the major plane of the envelope array. It may be noted that plastic is present between the lower portions of aperture 6 and the lower edge 5 of the envelope array. This means that each envelope 9 is coupled to a neighboring envelope. While the envelope array of FIG. 1 is preferred, one or two short envelopes such as 9' may be affixed to each notebook rather than the four tab linear array described above.

Figure 4:
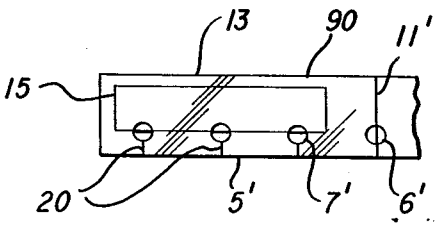

In FIG. 4, a set of slits 20 are cut between apertures 7 and the lower most edge 5' of the envelopes, in contrast with the aforesaid embodiment. This enables envelopes 9 (as an array of two or more envelopes or as a single envelope), to be sold to the user and affixed to stenographic notebooks by the user, in contrast with the aforesaid embodiment, which is mounted upon the notebook during the manufacturing process. The user aligns slits 20 with turns of coil spring 4, and presses against envelope 9 to cause the coils to be inserted within apertures 7. Removal of the tab illustrated in FIG. 4 is effected, by pulling the envelope away from the coil spring 4. Upper edge portion 13 and slits 11 function in the same manner as described earlier.

Removal of tabs 15 from the envelopes of FIGS. 1–4 is easily performed by inserting a narrow instrument such as a pencil, etc. into the side portions of the envelopes, whereby the point of the instrument presses against the tab to eject it from the opposite open side portion.

Figure 5:
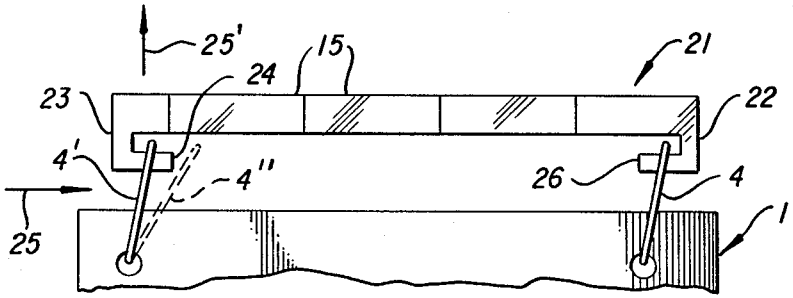

Another embodiment of the invention, illustrated in FIG. 5, enables an elongated indexing indicia support base member 21 to be quickly and easily mounted upon the coil spring 4 by the user. Member 21 is a thin flat metallic or plastic sheet cut into the configuration illustrated, and "stick-on" indexing tabs, which may be color coded, can be affixed to the major surface portion of member 21, to index the data within the notebook. A pair of catch members 22 and 23 are formed at opposite terminal portions of base member 21, and preferably include facing terminal hook portions 24 and 26, separated from each other by a distance slightly less than the length of the coiled spring binder member 4. Base member 21 is mounted upon the notebook by positioning hook member 22 about the right hand coil 4 as illustrated in FIG. 5, and the user thereafter pushes inwardly against the left hand coil member 4' in the direction of arrow 25 to cause 4' to assume the position shown at 4". The operator thereafter slips terminal hook portion 24 downwardly past the left hand coil element 4" and releases the pressure against the coil to cause it to reassume the position indicated at 4', and as a result base member 21 is now hooked to the coil spring. Alternatively, one hook can pull inwardly against one end of the coil spring while the other hook is inserted into the other end of the spring. Removal of base member 21 is easily and quickly performed by again causing 4' to be displaced to the position indicated at 4" and the left hand portion of base member 21 is lifted upwardly in the direction of arrow 25', to cause terminal hook portion 24 to pass by the left hand coil turn 4', which previously captured base member 21.

Numerous variations of the aforesaid embodiment will become apparent to those skilled in the art, and thus the scope of the invention is to be limited only by the terms of the following claims and art recognized equivalents thereof. For example, separate index tabs need not be applied to base member 21; rather the member could merely have a single writing surface thereon. The catch members illustrated in FIG. 5 could have other configurations, and the FIG. 5 embodiment could have a length much shorter than the coiled wire binding.

What is claimed is:

1. Method of mounting index tabs to coiled wire stenographic notebooks, comprising the steps of:

(a) providing a stenographic notebook having a coiled wire binding means;

(b) providing one or more elongated transparent plastic index tab containing envelopes having a longitudinal axis along the length thereof, and a plurality of aligned apertures therethrough extending along first envelope portions parallel to said longitudinal axis and adjacent a lower envelope edge, at least some of said apertures surrounding turns of said coiled wire, said envelopes also having two open side portions transverse to said longitudinal axis, and upper closed envelope edge portions parallel to said longitudinal axis; and (c) inserting index tabs through said open side portions of said envelopes until said tabs are contained within said envelopes.

2. The method of claim 1 wherein said envelopes are coupled to said coiled wire along a major portion of said envelopes, and said side portions are slits extending through major portions of said envelopes transverse to said longitudinal axis, and further including the step of pushing envelopes between said slits away from said longitudinal axis before the performance of step (c).

3. The method of claim 2 further including the step of removing said tabs by inserting a narrow object through said open side portions of said envelopes.

4. The method of claim 2 including the step of providing said open side portions are perpendicular to said longitudinal axis.

5. The method of claim 2 including the step of providing said slits into said apertures.

6. The method of claim 5 further including the step of removing said tabs by inserting a narrow object through said open side portions of said envelopes.

7. The method of claim 5 wherein a set of slits are formed between said apertures and said lower envelope edge and further including the step of passing said second set of slits over said coiled wire to attach said envelopes to said notebook.

8. The method of claim 7 further including the step of removing said tabs by inserting a narrow object through said open side portions of said envelopes.

9. The method of claim 1 including the step of providing said open side portions perpendicular to said longitudinal axis.

10. The method of claim 1 wherein a set of slits are formed between said apertures and said lower envelope edge and further including the step of passing said set of slits over said coiled wire to attach said envelopes to said notebook.

11. The method of claim 10 further including the step of removing said tabs by inserting a narrow object through said open side portions of said envelopes.

12. The method of claim 1 further including the step of removing said tabs by inserting a narrow object through said open side portions of said envelopes.

13. Method of mounting index tabs to coiled wire stenographic notebooks having coiled wire coupling means of a given length comprising the steps of:

(a) providing a stenographic notebook having a coiled wire binding means;

(b) providing an elongated indicia support base member having at least one area for recording indicia thereon, and having first and second catch members at opposite terminal portions of said base member; and (c) reducing the length of at least a portion of said coiled wire binding means by asserting pressure thereon, while slipping a catch member of said base member past said coiled wire and about a turn thereof to mount said base member upon said notebook.

14. The method of claim 13 including the step of separating said catch members from each other by a distance slightly less than said given length of said coiled wire coupling means.

15. Method of claim 13 including the step of affixing a plurality of aligned index tabs upon said elongated base member.

16. The method of claim 15 including the step of separating said catch members from each other by a distance slightly less than said given length of said coiled wire coupling means.

17. Method of mounting index tabs to coiled wire stenographic notebooks having coiled wire binding means of a given length comprising the steps of:

(a) providing a stenographic notebook having a coiled wire binding means;

(b) providing an indicia support base member having at least one area for recording indicia thereon, and having first and second catch members at opposite terminal portions of said base member, said catch members having facing terminal hook portions; and (c) reducing the length of at least a portion of said coiled wire binding means by asserting pressure thereon while slipping a catch member of said base member past said coiled wire and about a turn thereof to mount said base member upon said notebook.

18. The method of claim 17 including the step of affixing a plurality of aligned index tabs upon said elongated tab support base member.

19. The method of claim 18 including the step of separating said facing terminal hook portions are separated from each other by a distance slightly less than said given length of said coiled wire coupling means.

20. The method of claim 17 including the step of separating said facing terminal hook portions from each other by a distance slightly less than said given length of said coiled wire coupling means.

* * * * *